US009332359B2

(12) United States Patent
Recker

(10) Patent No.: US 9,332,359 B2
(45) Date of Patent: May 3, 2016

(54) CUSTOMIZATION OF ADAPTIVE DIRECTIONALITY FOR HEARING AIDS USING A PORTABLE DEVICE

(71) Applicant: Starkey Laboratories, Inc., Eden Prairie, MN (US)

(72) Inventor: Karrie LaRae Recker, Edina, MN (US)

(73) Assignee: Starkey Laboratories, Inc., Eden Prairie, MN (US)

( * ) Notice: Subject to any disclaimer, the term of this patent is extended or adjusted under 35 U.S.C. 154(b) by 235 days.

(21) Appl. No.: 13/739,830

(22) Filed: Jan. 11, 2013

(65) Prior Publication Data

US 2014/0198934 A1 Jul. 17, 2014

(51) Int. Cl.
*H04R 25/00* (2006.01)

(52) U.S. Cl.
CPC ..... *H04R 25/407* (2013.01); *H04R 25/402* (2013.01); *H04R 25/405* (2013.01); *H04R 25/40* (2013.01); *H04R 25/552* (2013.01)

(58) Field of Classification Search
CPC .... H04R 25/40; H04R 25/402; H04R 25/405; H04R 25/407; H04R 25/552
USPC ..... 381/313
See application file for complete search history.

(56) References Cited

U.S. PATENT DOCUMENTS

| | | | | |
|---|---|---|---|---|
| 3,946,168 | A | 3/1976 | Preves | |
| 7,457,426 | B2 * | 11/2008 | Drtina | 381/313 |
| 7,542,580 | B2 | 6/2009 | Burns | |
| 2002/0057817 | A1 | 5/2002 | Darbut | |
| 2011/0135126 | A1 | 6/2011 | Gozen | |
| 2011/0144779 | A1 * | 6/2011 | Janse et al. | 700/94 |
| 2013/0266165 | A1 * | 10/2013 | Neumeyer | 381/314 |
| 2014/0025287 | A1 * | 1/2014 | Christensen | 701/409 |

* cited by examiner

*Primary Examiner* — Matthew Eason
*Assistant Examiner* — Sean H Nguyen
(74) *Attorney, Agent, or Firm* — Schwegman Lundberg & Woessner, P.A.

(57) ABSTRACT

A hearing assistance system provides a hearing-aid wearer with one or more hearing aids and a portable device allowing for a wearer-driven directionality customization of the one or more hearing aids. The wearer indicates the locations of sound(s) of interest and/or noise source(s) using the portable device. The one or more hearing aids adjust the directionality of sound reception based on these wearer-indicated locations.

25 Claims, 4 Drawing Sheets

CUSTOMIZATION OF ADAPTIVE DIRECTIONALITY FOR HEARING AIDS USING A PORTABLE DEVICE

TECHNICAL FIELD

This document relates generally to hearing assistance systems and more particularly to one or more hearing aids with adaptive directionality and a portable device allowing for customization of that adaptive directionality by a wearer.

BACKGROUND

Hearing aids are used to assist people suffering hearing loss by transmitting amplified sounds to their ear canals. Damage of outer hair cells in a patient's cochlear results loss of frequency resolution in the patient's auditory perception. As this condition develops, it becomes difficult for the patient to distinguish speech from environmental noise. Simple amplification does not address such difficulty. Thus, there is a need to help such a patient in understanding speech in a noisy environment.

SUMMARY

A hearing assistance system provides a hearing-aid wearer with one or more hearing aids and a portable device allowing for a wearer-driven directionality customization of the one or more hearing aids. The wearer indicates the locations of sound(s) of interest and/or noise source(s) using the portable device. The one or more hearing aids adjust the directionality of sound reception based on these wearer-indicated locations. The adjusted directionality helps the wearer to understand the sound(s) of interest, such as speech in a noisy environment.

In one embodiment, the wearer of a hearing aid set is provided with a portable device. The hearing aid set includes one or more hearing aids and controls directionality of sound reception using one or more wearer-indicated locations each including a signal location or a noise location. The signal location is a location of a source of a sound of interest. The noise location is a location of a source of noise. The portable device includes a communication circuit, a user interface, and a processing circuit. The communication circuit communicates with the hearing aid set. The user interface receives user commands including a location command indicating the one or more wearer-indicated locations. The processing circuit produces a directionality customization signal using the location command and transmits the directionality customization signal to the hearing aid set using the communication circuit. The directionality customization signal allows the hearing aid set to control the directionality of sound reception.

In one embodiment, a hearing aid set including one or more hearing aids configured to be worn by a wearer is communicatively coupled to a portable device for use by the wearer. The hearing aid set includes microphones, one or more receivers, and a processing circuit. The microphones receive acoustic signals. The one or more receivers transmit one or more output audio signals to the wearer. The processing circuit produces the one or more output audio signals by processing the acoustic signals in real time and includes a directionality controller. The directionality controller receives a directionality customization signal from the portable device and controls a directionality of the microphones using the directionality customization signal. The directionality customization signal is indicative of one or more wearer-indicated locations each including a signal location or a noise location. The signal location is a location of a source of a sound of interest. The noise location is a location of a source of noise.

In one embodiment, a method allows for control of directionality of sound reception of a hearing aid set including one or more hearing aids configured to be worn by a wearer. User commands are received from the wearer using a portable device. The user commands include a location command indicating one or more wearer-indicated locations each including a signal location or a noise location. The signal location is a location of a source of a sound of interest. The noise location is a location of a source of noise. A directionality customization signal is produced using the location command. The directionality customization signal is transmitted to the hearing aid set for the hearing aid set to control the directionality of sound reception using the directionality customization signal in processing the acoustic signals.

This Summary is an overview of some of the teachings of the present application and not intended to be an exclusive or exhaustive treatment of the present subject matter. Further details about the present subject matter are found in the detailed description and appended claims. The scope of the present invention is defined by the appended claims and their legal equivalents.

DETAILED DESCRIPTION

Figure 1:
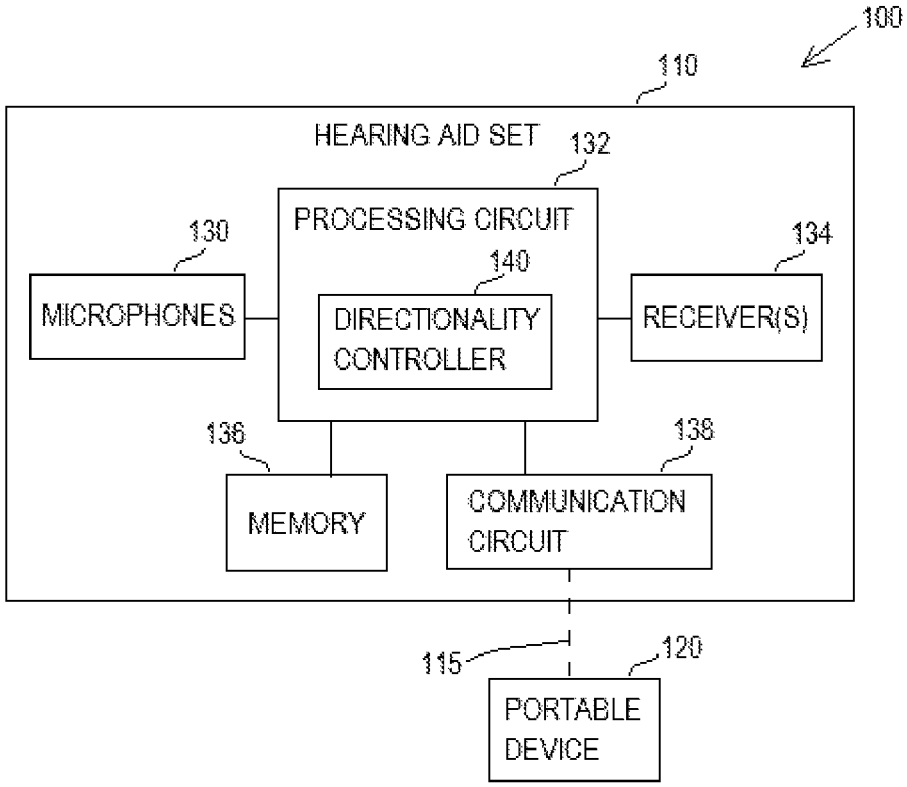
FIG. 1 is an illustration of an embodiment of a hearing assistance system including a hearing aid set and a portable device.

The following detailed description of the present subject matter refers to subject matter in the accompanying drawings which show, by way of illustration, specific aspects and embodiments in which the present subject matter may be practiced. These embodiments are described in sufficient detail to enable those skilled in the art to practice the present subject matter. References to "an", "one", or "various" embodiments in this disclosure are not necessarily to the same embodiment, and such references contemplate more than one embodiment. The following detailed description is demonstrative and not to be taken in a limiting sense. The scope of the present subject matter is defined by the appended claims, along with the full scope of legal equivalents to which such claims are entitled.

This document discusses a hearing assistance system including one or more hearing aids and a portable device for use by the wearer of the one or more hearing aids. The portable device allows the user (wearer) to control the directionality of sound reception for the one or more hearing aids. In this document, directionality of a "hearing aid set" is used for the purpose of discussing either one hearing aid or a pair of hearing aids worn by the same patient. In other words, the "hearing aid set" as discussed in this document may include to one or more hearing aids, such as a monaural hearing aid or a pair of binaural hearing aids.

Directional microphones have been used in a hearing aid set to improve signal-to-noise ratio (SNR) for sounds transmitted to a hearing-impaired listener in noisy situations. For example, the directional microphones in the hearing aid set may be designed to optimize a sound coming from one direction (such as in front of the wearer) while attenuating another sound coming from a different direction (such as behind the wearer). Directional microphones in an early hearing aid use fixed polar patterns, with which directions of maximum sensitivity and attenuation do not change. A limitation of this type of directionality is the inability to adapt to optimize the SNR based on acoustics of a particular environment. Adaptive directionality has become possible with application of digital technology in hearing aids. By adjusting time delays between the two microphones, the polar pattern of the directionality can be altered to optimize the SNR for a particular environment. However, this type of adaptive directionality has problems such as discussed as follows.

For example, before the hearing aid set can adapt its processing to maximize the SNR, it must analyze the signals from the microphones to estimate locations of signal(s) of interest and noise source(s). Only after these locations in a particular environment are determined or estimated, the hearing aid set can adjust its signal processing to optimize the SNR for that environment. The process of analyzing and then adapting to the environment may consume substantial amount of time such that the wearer misses important information from the signal(s) of interest during the process.

Another example of a problem with adaptive directionality is that even if the hearing aid set is able to optimize the SNR for a particular environment, the signal optimized may not be the actual signal of interest. When hearing aid is designed or programmed to consider speech as the signal of interest, it optimizes the processing for speech wherever it is detected. Consequently, the hearing aid may optimize reception of speech from a talker other than the talker of interest (i.e., the person with whom the hearing aid wearer hopes to communicate). This may result in missed information when the talker of interest speaks. Such scenario can occur in any environment with multiple talkers in multiple locations, such as in restaurants, parties, sporting events, and cars.

To address such problems of adaptive directionality of a hearing aid, the present hearing assistance system provides the wearer of the hearing aid with a portable device that allows for a wearer-driven directionality customization of the hearing aid. The wearer indicates the locations or directions of signal(s) of interest and/or noise source(s) to the hearing aid through the portable device. In response, the hearing aid optimizes the SNR of the sound transmitted to the wearer based on these wearer-indicated locations. Thus, the present hearing assistance system allows the wearer of the hearing aid to indicate where the signal(s) of interest are and where the noise source(s) are so that the hearing aid can optimize its directional pattern to optimize the SNR for a particular environment as indicated by the wearer.

In various embodiments, following an initial optimization based on the locations or directions of signal(s) of interest and/or noise source(s) indicated by the user (wearer), the hearing aid may (1) set its directionality at a fixed angle until the next initial optimization, (2) dynamically adjusts its directionality by tracking the wearer's head movement, (3) dynamically adjusts its directionality by tracking the movements of the signal(s) of interest and/or the noise source(s), or (4) dynamically adjusts its directionality by concurrently tracking both the wearer's head movement and the movements of the signal(s) of interest and/or the noise source(s).

In various embodiments, the present hearing assistance system reduces or eliminates difficulties or problems associated with depending on the hearing aid to determine signal and noise locations. The present hearing assistance system a user (wearer)-driven directionality control that is customized to an individual wearer of a hearing aid in a specific environment where the hearing aid functions. Such a directionality control provides an interactive tool that increases the hearing-aid wearer's participation in the rehabilitation process. The accuracy of directionality control is improved because the hearing aid can focus on the signal(s) of interest as indicated by the wearer, rather than "guessing" which signal(s) the wearer wants to hear and which signal(s) the wearer does not want or care to hear. The time required for the hearing aid to analyze an environment before adapting to that environment is eliminated, allowing the hearing aid to optimize its SNR quickly, thereby giving immediate satisfaction to the wearer and reducing chances of missing information due to hearing aid's processing time. The portable device may also be considered as a cool, fun gadget for tech-savvy patients.

In various embodiments, wearer-driven directionality customization may be implemented as one of many applications on a portable device, such as a hand-held device, provided to the wearer of a hearing aid for optimization of the hearing aid. Examples of other applications implemented on the portable device may include gain and compression adjustments, memory/volume controls, and aural rehabilitation applications.

FIG. 1 is an illustration of an embodiment of a hearing assistance system 100 including a hearing aid set 110 and a portable deice 120. Hearing aid set 110 is configured to be worn by a wearer. Portable device 120 is configured for use by the wearer to communicate with hearing aid set 110 via a communication link 115. Hearing aid set 110 includes microphones 130, a processing circuit 132, one or more receivers (speakers) 134, a memory 136, and a communication circuit 138. In various embodiments, examples of hearing aid set 110 include one or more hearing aids, as discussed below with reference to FIGS. 2 and 3.

Microphones 130 receive acoustic signals. When hearing aid set 110 is worn by the wearer, the acoustic signals may include one or more sounds of interest and one or more noise signals. The one or more sounds of interest are each a sound that the wearer wants to hear, such as a speech from a person the wearer intends to talk to or hear from. The one or more noise signals are each an environmental sound that the wearer does not intend to hear, such as machine noises and conversations from people the wearer is not communicating with.

Receiver(s) 134 transmit one or more output audio signals to the wearer. The one or more output audio signals each have a signal-to-noise ratio (SNR). It is generally desirable to maximize the SNR for each output audio signal such that the wearer can hear each sound of interest with reduced background noise.

Processing circuit 132 produces the one or more output audio signals by processing the acoustic signals in real time. Processing circuit 132 includes a directionality controller 140 that is configured to receive a directionality customization signal from portable device 120 and control a directionality of microphones 130 using the directionality customization signal. The directionality customization signal is indicative of one or more signal locations and/or one or more noise location. The one or more signal locations are each a location of a source of a sound of interest. The one or more noise locations are each a location of a source of noise. In various embodiments, the directionality customization signal may indicate any number (including zero) of signal locations and any number (including zero) of noise locations, depending on, for example, what (if any) the wearer desires to focus on and what (if any) the wearer desires to avoid. The directionality of microphones 130 (i.e., the directionality of sound reception by hearing aid set 110) may be represented by a polar pattern of sensitivity of microphones 130 in sound reception plotted as a function of direction (angles relative to the orientation of the microphones). It is generally desirable to adjust the polar pattern such that the microphones are most sensitive towards the one or more signal locations and least sensitive towards the one or more noise locations. In various embodiments, directionality controller 140 is configured to optimize the directionality in real time to approximately maximize the one or more SNRs of the one or more output audio signals using the directionality customization signal.

Memory 136 stores various data used for operation of hearing aid set 110, including data associated with the directionality. In one embodiment, the stored data include one or more location presets each being a previously recorded set of the one or more signal locations and/or one or more noise locations. The directionality customization signal may indicate the one or more signal locations and/or the one or more noise locations by specifying a location preset of the one or more location presets that have been previously stored in memory 136.

Communication circuit 138 provides hearing aid set 110 with communication from and/or to portable device 120. Processing circuit 132 receives the directionality customization signal from portable device 120 via communication link 115 using communication circuit 138. In one embodiment, communication link 115 is a wireless link. In another embodiment, communication link 115 is a wired link using an electronic connection device such as a cable.

Figure 2:
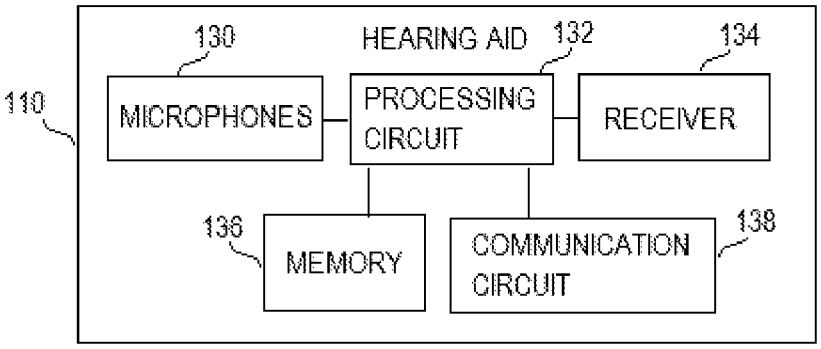
FIG. 2 is a block diagram illustrating an embodiment of the hearing aid set.

FIG. 2 is a block diagram illustrating an embodiment in which hearing aid set 110 is configured as a monaural hearing aid 110. Monaural hearing aid 110 includes microphones 134, processing circuit 132, receiver 134, memory 136, and communication circuit 138.

Figure 3:
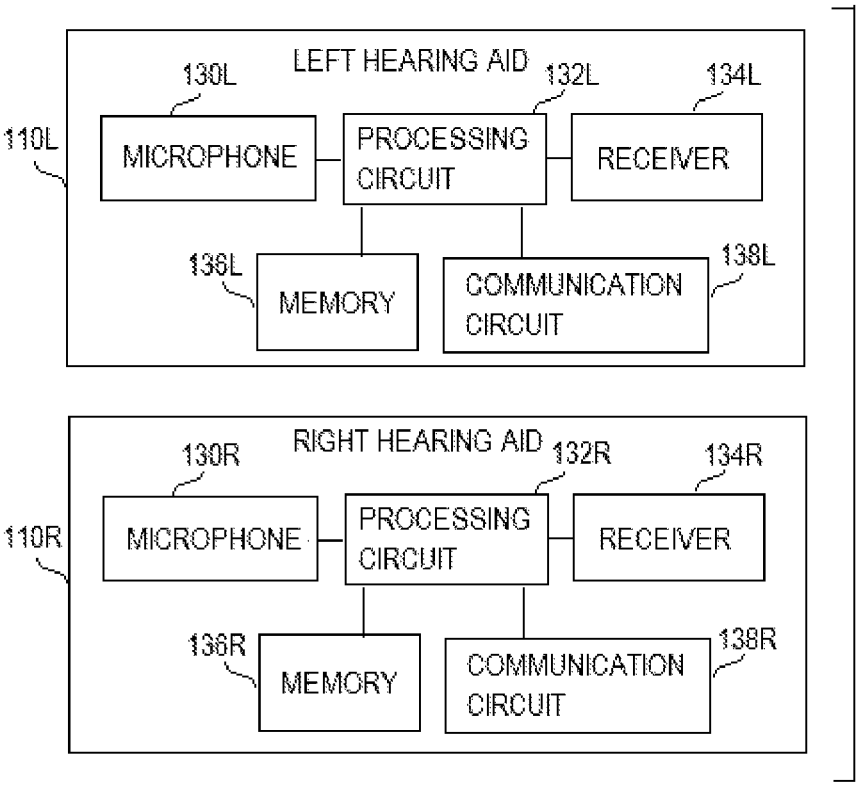
FIG. 3 is a block diagram illustrating another embodiment of a hearing aid set.

FIG. 3 is a block diagram illustrating an embodiment in which hearing aid set 110 is configured as a pair of binaural hearing aids, which includes a left hearing aid 110L and a right hearing aid 110R. Left hearing aid 110L includes a microphone 130L of microphones 130, a processing circuit 132L of processing circuit 132, a receiver 134L of receivers 134, a memory 136L of memory 136, and a communication circuit 138L of communication circuit 138. Right hearing aid 110R includes a microphone 130R of microphones 130, a processing circuit 132R of processing circuit 132, a receiver 134R of receivers 134, a memory 136R of memory 136, and a communication circuit 138R of communication circuit 138. In one embodiment, binaural hearing aids 110L and 110R are capable of ear-to-ear communication, which is controlled by processing circuits 132L and 132R and performed by communications circuits 138L and 138R.

Figure 4:
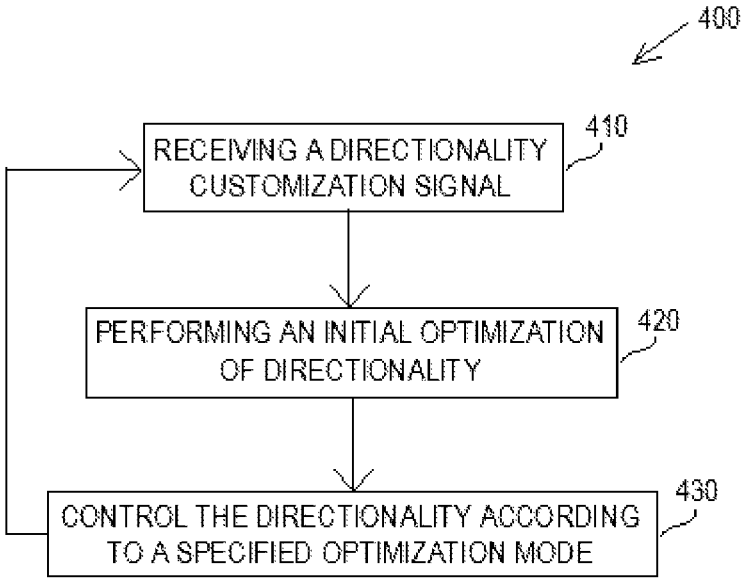
FIG. 4 is a flow chart illustrating an embodiment of a method for controlling directionality of the hearing aid set.

FIG. 4 is a flow chart illustrating an embodiment of a method 400 for controlling the directionality of a hearing aid set such as hearing aid set 110. In various embodiments, method 400 is performed by a hearing aid set including one or more hearing aids, such as hearing aid set 110, including its various embodiments. In one embodiment, directionality controller 140 is configured to perform method 400 for controlling the directionality of microphones 130 (i.e., directionality of hearing aid set 110).

At 410, a directionality customization signal is received. As discussed above with reference to FIG. 1, the directionality customization signal is indicative of one or more signal locations each being a location of a source of a sound of interest and/or one or more noise locations each being a location of a source of noise.

At 420, an initial optimization of directionality is performed using the directionality customization signal in response to reception of the directionality customization signal. In various embodiments, the initial optimization of directionality is performed for an approximately maximized SNR for each of the one or more output audio signals for the one or more signal locations and/or the one or more noise locations indicated by the directionality customization signal.

At 430, following the initial optimization, the directionality is controlled according a specified optimization mode. In various embodiments, hearing aid set 110 may maintain the directionality resulting from the initial optimization for a certain amount of time (such as specified by the manufacturer or the wearer of the hearing aid set) or until a change occurs (such as when a change is made to the directionality using portable device 120, when a relevant change is made the content of memory 136, or when hearing aid set 110 is rebooted). In one embodiment, the optimization mode may be selected and reselected by the wearer using portable device 120. Various embodiments of step 430 are discussed as follows by way of example, but not by way of restriction.

In one embodiment, the directionality is fixed for an angle set during the initial optimization after the initial optimization. For example, if the wearer indicates, using portable device 120, that the signal of interest is at 90°, as may occur for a driver of a vehicle with a front-seat passenger, the directionality will remain optimized for that angle.

In another embodiment, the directionality is dynamically adjusted by tracking head movement of the wearer after the initial optimization, such as by using a compass or a gyroscope. When the wearer changes his/her head position, the directionality will be adjusted accordingly. This type of functionality may be useful in situations such as sporting events in which the wearer may toggle his/her attention between the person at his side and the sporting event.

In another embodiment, the directionality is dynamically adjusted by tracking movements of the one or more signal locations and/or the one or more noise locations after the initial optimization. For example, when the hearing-aid wearer indicates that the signal of interest is at 45°, environmental classification can be used to determine the acoustic characteristics of the signal at that angle. The hearing aid set will then track that signal using its acoustic characteristics when it moves from its original spot. This type of functionality may be useful in situations such as cocktail parties, where the signals of interest (other talkers) are likely mobile. In various embodiments, the directionality may be dynamically adjusted by tracking movements of one or more locations selected from the one or more signal locations and/or the one or more noise locations after the initial optimization.

In another embodiment, the directionality is dynamically adjusted by concurrently tracking head movement of the wearer and movements of the one or more signal locations and/or the one or more noise locations after the initial optimization. When hearing aid set 110 is configured as a pair of binaural hearing aids, such as left hearing aid 110L and right hearing aid 110R, the wearer can be provided with the option of optimizing both hearing aids together or separately. Bilateral customization may be ideal when there is only one signal of interest, while individual optimization may offer more benefit when multiple signals (that are not co-located) are of interest. For example, when the wearer is talking to two people at a party—one at −45° and one at 45°, it may be advantageous for left hearing aid 110L to focus on the −45° signal and right hearing aid 110R to focus on the 45° signal, rather than having both hearing aids 110L and 110R to focus on both signals. In another example, hearing aids 110L and 110R can be configured (e.g., by the manufacturer, or by the wearer using portable device 120) to monitor multiple angles of interest and adjust the directionality to focus on one of the signals of interest that is associated with the best SNR of the output audio signals at a time. In another embodiment, the directionality is dynamically adjusted by concurrently tracking head movement of the wearer and movements of one or more locations selected from the one or more signal locations and/or the one or more noise locations after the initial optimization.

Figure 5:
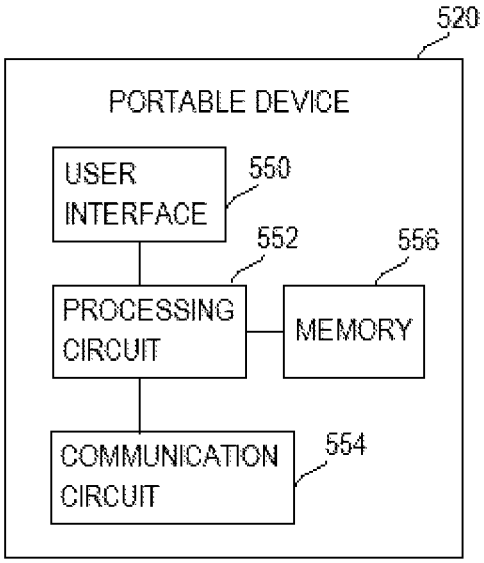
FIG. 5 is a block diagram illustrating an embodiment of the portable device.

FIG. 5 is a block diagram illustrating an embodiment of a portable device 520. Portable device 520 represents an embodiment of portable device 120 and includes a user interface 550, a processing circuit 552, a communication circuit 554, and a memory 556. In various embodiments, portable device 520 is configured to be used by the wearer of hearing aid set 110, including its various embodiments. In one embodiment, portable device 520 is configured as a hand-held device. In one embodiment, portable device 520 is implemented by incorporating its directionality control functionality as discussed in this document into a hand-held device capable of communicating with a hearing aid set such as hearing aid set 110. For example, the directionality control functionality may be installed as one of the applications available for that hand-held device.

User interface 550 receives user commands, which include a location command indicating the one or more signal locations and/or the one or more noise locations. Examples of other user commands include a user command for starting the initial optimization and a user command for selecting optimization bilaterally or individually for left hearing aid 110L and right hearing aid 110R. In one embodiment, user interface 550 includes a touch screen to receive the user commands. The touch screen is configured to display a graphical representation of an environment in which hearing aid set 110 operates and allow the wearer to identify the one or more signal locations and/or the one or more noise locations on the graphical representation. The wearer may use his/her finger or a stylet to indicate the one or more signal locations and/or the one or more noise locations on the touch screen. In other embodiments, user interface 550 includes any user input mechanism allowing the wearer to enter the user commands. Examples of such user input mechanism includes buttons, keys, and touch pad.

Communication circuit 554 provides portable device with communication from and/or to portable device 120 via communication link 115. Processing circuit 552 produces the directionality customization signal using the location command and transmits the directionality customization signal to hearing aid set 110 via communication link 115 using communication circuit 554. Memory 556 stores data required for operation of portable device 520, including data related to the processing of the location command.

Figure 6:
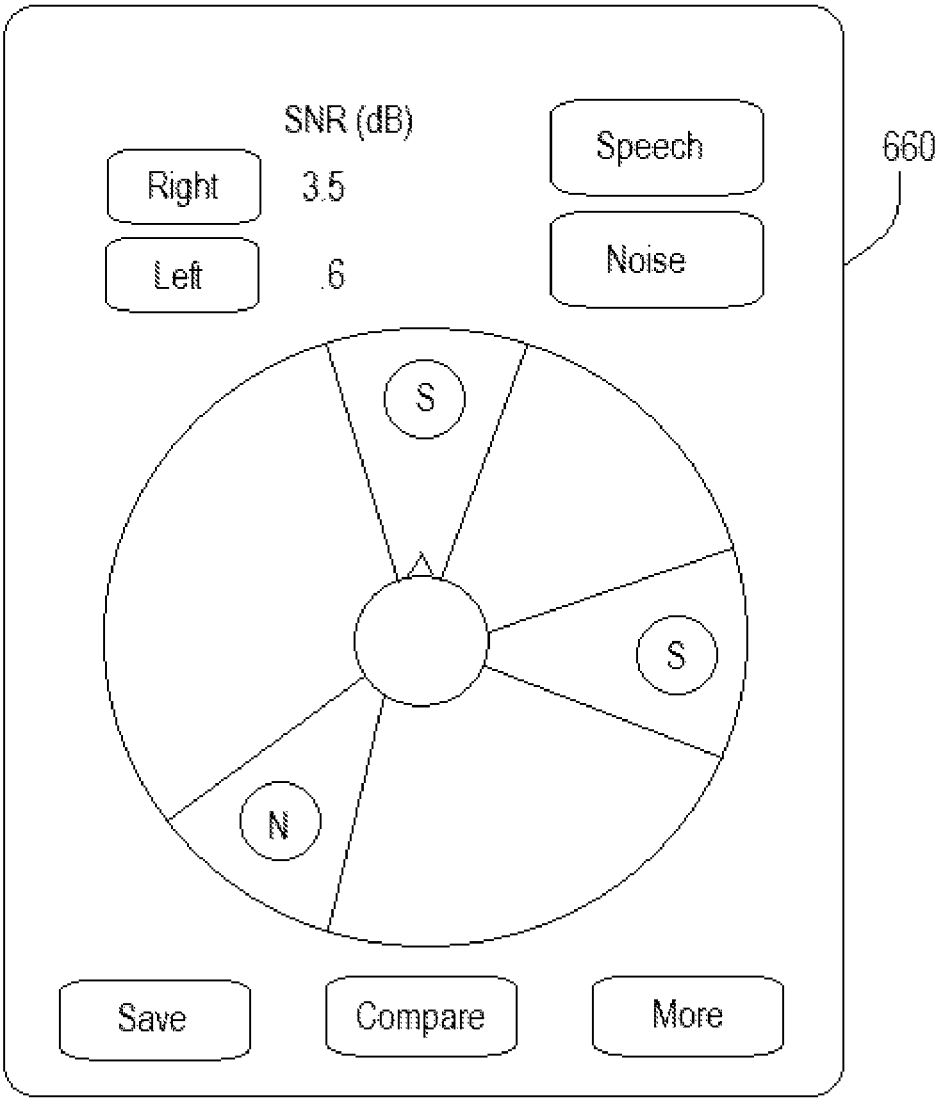
FIG. 6 is an illustration of an embodiment of a touch screen of the portable device.

FIG. 6 is an illustration of an embodiment of a touch screen 660 of user interface 550. Touch screen 660, which is illustrated by way of example, but not by way of restriction, displays a graphical representation (a circle) of an environment in which hearing aid set 110 operates and allow the wearer to identify the one or more signal locations ("Speech", or "5") and the one or more noise locations ("Noise", or "N"). The wearer may use his/her finger or a stylet to add and/or move the one or more signal locations and/or the one or more noise locations within the circle. While two signal locations and one noise location are illustrated in FIG. 6 as an example, in various embodiments, the wearer can indicate any number (including zero) of signal locations and any number (including zero) of noise locations.

In one embodiment, touch screen 660 also represents one or more indications of the directionality. The one or more indications indicate to the wearer that that hearing aid set 110 is focusing on the one or more signals of interest. In the illustrated example, an updated estimate of the SNR of the output audio signal for each of left hearing aid 110L ("Left") and right hearing aid 110R ("Right") are displayed on touch screen 660. In another example, the directionality as represented by an updated polar pattern is displayed on touch screen 660.

In one embodiment, touch screen 660 also presents a location-saving command input (such as the "Save" button illustrated in FIG. 6) to the wearer to receive a location-saving command of the user commands. In response to the location-saving command, processing circuit 552 saves the one or more signal locations and one or more noise locations as displayed on touch screen 660 as a location preset of the stored one or more location presets in memory 556 of portable device 520 or send them to hearing aid set 110 to be saved in memory 136. Thus, memory 556 and/or memory 136 store one or more previously recorded location presets of the one or more signal locations and/or one or more noise locations. A subsequent location command may specify a location preset of the stored one or more location presets.

In one embodiment, the touch screen 660 also presents a performance-comparison command input (such as the "Compare" button illustrated in FIG. 6) to the wearer to receive a performance-comparison command of the user command. In response to the performance-comparison command, processing circuit 552 performs a comparison between the directionality optimized using the directionality customization signal and a different directionality setting such as an omnidirectional or fixed directional setting or an adaptive directionality setting resulting from a different optimization, such as a directionality optimized using one or more signal locations and/or one or more noise locations automatically determined by the hearing aid set, and presents result of the comparison on touch screen 660. In one embodiment, touch screen 660 displays the one or more signal locations and/or one or more noise locations automatically determined by the hearing aid set to allow the wearer to compare. In one embodiment, touch screen 660 displays the polar pattern associated with each of the directionality settings to allow the wearer to compare. In one embodiment, the result presented on touch screen 660 includes the SNRs for the right and left hearing aids, updated based on the directionality setting selected. In one embodiment, the result presented on touch screen 660 includes the estimated SNRs associated with the directionality optimized using the directionality customization signal and the estimated SNRs associated without the wearer entering the location command. For example, if the signal of interest is at 45°, but there is a louder competing signal at −45°, the directionality may be optimized for the signal at −45°. The result presented on touch screen 660 includes an estimate of the SNR at the 45° angle with the directionality optimized for −45° angle). The difference between this SNR estimate and the SNR estimate resulting from the optimization using the directionality customization signal indicates the benefit provided by the latter.

In one embodiment, the touch screen 660 also presents a data-logging command input to the wearer to receive a data-logging command of the user commands. In the illustrated embodiment, touch screen 660 displays a "More" button that allows the wearer to access additional commands, including the data-logging command. In response to the data-logging command, processing circuit 552 records data associated with changes in the directionality and stored the data in memory 556. Examples of the data to be recorded include data indicative of the frequency of usage of the wearer-driven directionality customization and/or other directionality control feature, data indicative of location adjustments made by the wearer (e.g., number and/or contents of location commands entered), and acoustic characteristics of the environment as determined by hearing aid set 110 and/or portable device 520 (e.g. sound level estimates, SNR estimates, and signal and noise locations).

In various embodiments, the circuit of hearing assistance system 100, including its various elements discussed in this document, is implemented using hardware, software, or a combination of hardware and software. In various embodiments, processing circuits 132 and 552, including their various elements (such as directionality controller 140), may be implemented using one or more circuits specifically constructed to perform one or more functions discussed in this document or one or more general-purpose circuits programmed to perform such one or more functions. Examples of such general-purpose circuit can include a microprocessor or a portion thereof, a microcontroller or portions thereof, and a programmable logic circuit or a portion thereof.

The present subject matter is demonstrated for hearing assistance devices, including hearing aids, including but not limited to, behind-the-ear (BTE), on-the-ear (OTE), receiver-in-canal (RIC), in-the-ear (ITE), in-the-canal (ITC), completely-in-the-canal (CIC), or invisible-in-the-canal (IIC) type hearing aids. It is understood that BTE type hearing aids may include devices that reside substantially behind the ear or over the ear. Such devices may include hearing aids with receivers associated with the electronics portion of the behind-the-ear device, or hearing aids of the type having receivers in the ear canal of the wearer, including but not limited to receiver-in-canal (RIC) or receiver-in-the-ear (RITE) designs. The present subject matter can also be used in hearing assistance devices generally. It is understood that other hearing assistance devices not expressly stated herein may be used in conjunction with the present subject matter.

This application is intended to cover adaptations or variations of the present subject matter. It is to be understood that the above description is intended to be illustrative, and not restrictive. The scope of the present subject matter should be determined with reference to the appended claims, along with the full scope of legal equivalents to which such claims are entitled.

What is claimed is:

1. A portable device for use by a wearer of a hearing aid set including one or more hearing aids, the hearing aid set receiving a directionality customization signal from the portable device and controlling directionality of sound reception using the directionality customization signal, the portable device comprising:

a communication circuit configured to communicate with the hearing aid set;

a user interface configured to allow the wearer to enter user commands including a location command indicating one or more wearer-indicated locations each including a signal location identified by the wearer or a noise location identified by the wearer, the signal location being a location of a source of a sound of interest, the noise location being a location of a source of noise; and a processing circuit coupled to the user interface and the communication circuit, the processing circuit configured to produce the directionality customization signal using the location command and transmit the directionality customization signal to the hearing aid set using the communication circuit.

2. The portable device of claim 1, wherein the portable device is configured to be a hand-held device, and the communication circuit is configured to communicate with the hearing aid set using a wireless communication link.

3. The portable device of claim 1, wherein the user interface comprises a touch screen to receive the user commands.

4. The portable device of claim 3, wherein the processing circuit is configured to display on the touch screen a graphical representation of an environment in which the hearing aid set operates and allow the wearer to identify the one or more wearer-indicated locations on the graphical representation.

5. The portable device of claim 4, wherein the processing circuit is configured to display on the touch screen one or more indications of the directionality of sound reception.

6. The portable device of claim 5, wherein the processing circuit is configured to display on the touch screen a polar pattern representative of the directionality of sound reception.

7. The portable device of claim 5, wherein the processing circuit is configured to display on the touch screen one or more signal-to-noise ratios associated with the directionality of sound reception.

8. The portable device of claim 7, wherein the processing circuit is configured to display on the touch screen a signal-to-noise ratio for each of a left hearing aid and a right hearing aid of the hearing aid set.

9. The portable device of claim 4, comprising a memory configured to store one or more location presets each being a previously recorded set of the one or more wearer-indicated locations, the user interface is configured to receive a location-saving command of the user commands for saving the one or more wearer-indicated locations as indicated by the location command as a location preset of the stored one or more location presets.

10. The portable device of claim 4, wherein the user interface is configured to receive a performance-comparison command of the user commands, and the processing circuit is configured to perform a comparison between the directionality of sound reception approximately optimized using the directionality customization signal and a different setting of the directionality of sound reception and present the result of the comparison using the user interface in response to the performance-comparison command.

11. The portable device of claim 10, wherein the processing circuit is configured to perform the comparison between the directionality of sound reception approximately optimized using the directionality customization signal and an omnidirectional setting of the directionality of sound reception.

12. The portable device of claim 10, wherein the processing circuit is configured to perform the comparison between the directionality of sound reception approximately optimized using the directionality customization signal and a fixed setting of the directionality of sound reception.

13. The portable device of claim 10, wherein the processing circuit is configured to perform the comparison between the directionality of sound reception approximately optimized using the directionality customization signal and a directionality setting based on one or more of the signal and noise locations that are automatically determined by the hearing aid set.

14. The portable device of claim 13, wherein the processing circuit is configured to display on the touch screen the one or more of the signal and noise locations that are automatically determined by the hearing aid set.

15. The portable device of claim 14, wherein the processing circuit is configured to display on the touch screen the one or more indications of the directionality of sound reception associated with the directionality setting based on the one or more of the signal and noise locations that are automatically determined by the hearing aid set.

16. The portable device of claim 4, comprising a memory, and wherein the user interface is configured to receive a data-logging command of the user commands, and the processing circuit is configured to record data associated with changes in the directionality of sound reception and store the data in the memory in response to the data-logging command.

17. A method for controlling directionality of sound reception of a hearing aid set including one or more hearing aids configured to be worn by a wearer, the method comprising:

receiving user commands using a portable device configured to allow the wearer to enter the user commands, the user commands including a location command indicating one or more wearer-indicated locations each including a signal location or a noise location in acoustic signals to be received by the hearing aid set, the signal location identified by the wearer as a location of a source of a sound of interest, the noise location identified by the wearer as a location of a source of noise;

producing a directionality customization signal using the location command; and transmitting the directionality customization signal to the hearing aid set for the hearing aid set to control the directionality of sound reception using the directionality customization signal in processing the acoustic signals.

18. The method of claim 17, wherein transmitting the directionality customization signal to the hearing aid comprises transmitting the directionality customization signal to the hearing aid using a wireless communication link.

19. The method of claim 17, wherein transmitting the directionality customization signal to the hearing aid comprises transmitting the directionality customization signal to the hearing aid using a cable.

20. The method of claim 17, wherein receiving user commands using the portable device comprises receiving the user commands using a touch screen of the portable device.

21. The method of claim 20, comprising displaying a graphical representation of an environment in which the hearing aid operates to allow the wearer to identify the one or more wearer-indicated locations on the graphical representation.

22. The method of claim 21, comprising presenting one or more indications of the directionality of sound reception on the touch screen.

23. The method of claim 22, comprising performing an initial optimization of the directionality using the directionality customization signal using the hearing aid set.

24. The method of claim 23, comprising fixing the directionality for an angle set by the initial optimization after the initial optimization.

25. The method of claim 23, comprising dynamically adjusting the directionality by tracking one or more of head movement of the wearer or movements of one or more locations of the one or more wearer-indicated locations after the initial optimization.

* * * * *